US011787512B2

(12) United States Patent
Bernsen

(10) Patent No.: US 11,787,512 B2
(45) Date of Patent: Oct. 17, 2023

(54) BOARDS FOR BOARD SPORTS, AND RELATED SETS

(71) Applicant: Collin D. Bernsen, Calabasas, CA (US)

(72) Inventor: Collin D. Bernsen, Calabasas, CA (US)

( * ) Notice: Subject to any disclaimer, the term of this patent is extended or adjusted under 35 U.S.C. 154(b) by 109 days.

(21) Appl. No.: 17/317,554

(22) Filed: May 11, 2021

(65) Prior Publication Data

US 2022/0363350 A1 Nov. 17, 2022

(51) Int. Cl.
*B63B 32/40* (2020.01)
*B63B 32/50* (2020.01)
*B63B 32/77* (2020.01)

(52) U.S. Cl.
CPC ..... *B63B 32/40* (2020.02); *B63B 32/50* (2020.02); *B63B 32/77* (2020.02)

(58) Field of Classification Search
CPC ..... B63B 32/00; B63B 32/40; B63B 32/50; B63B 32/59; B63B 32/77
USPC ..... 441/65
See application file for complete search history.

(56) References Cited

U.S. PATENT DOCUMENTS 3,377,977 A 4/1968 Malm
4,129,313 A 12/1978 Benson
4,865,572 A 9/1989 Andes
7,029,351 B1 * 4/2006 Reid ..... B63B 32/77 441/74
8,025,541 B2 9/2011 Churchill et al.
8,298,027 B1 10/2012 Basse
8,789,488 B2 7/2014 Ruiz
8,839,735 B2 9/2014 VanNimwegen et al.
8,944,440 B2 * 2/2015 Elkinton ..... B63B 32/77 280/14.28
10,646,771 B1 * 5/2020 Jacobsma ..... A63C 17/0013
2004/0259438 A1 12/2004 Wang
2005/0247248 A1 11/2005 Caplan et al.
2009/0305588 A1 12/2009 McKee
2010/0105263 A1 4/2010 Churchill et al.
2013/0102211 A1 4/2013 Ruiz
2019/0168065 A1 6/2019 Brancatelli
(Continued)

FOREIGN PATENT DOCUMENTS

CN 206155743 U 5/2017
CN 209938884 U 1/2020
(Continued)

OTHER PUBLICATIONS

International Search Report for International Application No. PCT/US2022/072087, dated Aug. 23, 2022, 4 pages.
(Continued)

*Primary Examiner* — Lars A Olson
(74) *Attorney, Agent, or Firm* — Ray Quinney & Nebeker

(57) ABSTRACT

A board for a water sport comprises a front surface, a back surface, an upper surface between the front surface and the back surface, a first recess proximate the front surface and within the upper surface, the first recess comprising one or more attachment means for removably attaching a training device to the upper surface, and a second recess proximate the back surface and within the upper surface, the second recess comprising one or more additional attachment means for removably attaching a guidance device configured to facilitate at least partial control of the board. Related sets and boards for water sports are also disclosed.

22 Claims, 8 Drawing Sheets

(56) References Cited

U.S. PATENT DOCUMENTS

| | | | |
|---|---|---|---|
| 2019/0248451 | A1 | 8/2019 | Yeh et al. |
| 2020/0055575 | A1 | 2/2020 | Yeh et al. |

FOREIGN PATENT DOCUMENTS

| | | | |
|---|---|---|---|
| GB | 2486447 | A | 6/2012 |
| WO | 2021040682 | A1 | 3/2021 |

OTHER PUBLICATIONS

International Written Opinion for International Application No. PCT/US2022/072087, dated Aug. 23, 2022, 4 pages.

* cited by examiner

BOARDS FOR BOARD SPORTS, AND RELATED SETS

TECHNICAL FIELD

Embodiments of the disclosure relate generally to water sports and water sport training devices. More particularly, embodiments of the disclosure relate to a board for a water sport, the board including removably attachable training devices and guidance devices and configured for training a user for the water sport.

BACKGROUND

Water sports involve various sports including bodyboarding, boogie boarding, skimboarding, surfing, paddle boarding, wakeboarding, wake foiling, waterskiing, tubing, among other sports. Some water sports (e.g., wakeboarding, waterskiing, tubing) include being towed by a watercraft, while other water sports do not include being towed behind a watercraft.

In body boarding, boogie boarding, skimboarding, the user positions themselves on the respective board in a body of water (e.g., the ocean, a lake, a pond) and rides on the board in the water. The user may skim on the surface of the water and may remain in shallow calm waters and/or ride the board on a wave, such as a shore break, a beach break, or a reef break.

Due to the inherent danger (e.g., risk of drowning) of water sports, infants, toddlers, and young children and infants generally do not participate in water sports, at least until they are able to swim and exhibit sufficient balancing skills to maintain a proper position on the board during use and operation. Parents of such children often desire to teach their children how to participate in water sports, but are hesitant to introduce their children to water sports until their children are older or know how to swim.

BRIEF SUMMARY

In accordance with one embodiment described herein, a board for a water sport comprises a front surface, a back surface, an upper surface between the front surface and the back surface, a first recess proximate the front surface and within the upper surface, the first recess comprising one or more attachment means for removably attaching a training device to the upper surface, and a second recess proximate the back surface and within the upper surface, the second recess comprising one or more additional attachment means for removably attaching a guidance device configured to facilitate at least partial control of the board.

In additional embodiments, a set for a board for a water sport comprises a board for a water sport, a training device, and a guidance device. The training device comprises a first mounting plate configured to be removably attached to the board within a first recessed portion, and a first handle coupled to the first mounting plate. The guidance device comprises a second mounting plate configured to be removably attached to the board within a second recessed portion, and a second handle coupled to the second mounting plate.

In further embodiments, a board for a water sport comprises a training device configured to removably attach to a front portion of the board, and a guidance device configured to removably attach to a back portion of the board. The training device comprises a first mounting plate configured to removably attach to the front portion of the board, vertically extending posts coupled to the mounting plate, and a first handle coupled to the vertically extending posts. The guidance device comprises a second mounting plate configured to removably attach to the back portion of the board, an angled post coupled to the second mounting plate, and a second handle coupled to the angled post.

DETAILED DESCRIPTION

Figure 1B:
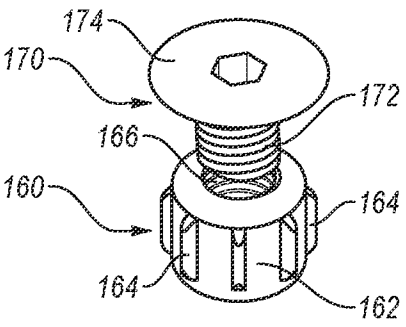
FIG. 1B is a simplified exploded view illustrating an attachment means and a fastener configured to couple with the attachment means for attaching a removable attachment to the board, in accordance with embodiments of the disclosure.

The following description provides specific details, such as material types, dimensions, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow, apparatus, or system for forming a board for water sports (e.g., bodyboard, a boogie board). Only those process acts and structures necessary to understand the embodiments of the disclosure are described in detail below. Additional acts to form a final structure including the materials and methods described herein may be performed by conventional techniques. Also note, any drawings accompanying the present application are for illustrative purposes only, and are thus not drawn to scale. Additionally, elements common between figures may retain the same numerical designation.

As used herein, the term "configured" refers to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, the singular forms "a," "an," and "the" are intended to include the plural forms as well, unless the context clearly indicates otherwise.

As used herein, "and/or" includes any and all combinations of one or more of the associated listed items.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the terms "longitudinal," "vertical," "lateral," and "horizontal" are in reference to a major plane of a substrate (e.g., base material, base structure, base construction, etc.) in or on which one or more structures and/or features are formed and are not necessarily defined by Earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

According to embodiments described herein, a board for water sports, such as a bodyboard or a boogie board, is configured to receive one or more removable attachment features (e.g., structures, devices, assemblies). The one or more removable attachment features may be configured to facilitate training of a user on the board and use of the board by a user who cannot safely swim. A first region of the board may be configured to facilitate interchangeable (e.g., removable) attachment of one or more different training devices to the board. The training devices may include devices configured to be removably attached to the first region of the board and may include devices for facilitating training a user to operate the board in a prone position (on the user's stomach), in the kneeling position, in the sitting position, or in the standing position. Depending on a level of experience of the user (e.g., the ability of the user to swim), the one or more training devices may be interchanged to facilitate a desired operation of the board. The board may further include a second region configured to facilitate removable attachment of a guidance device configured to facilitate operation of the board by a trainer (e.g., a person training the user on the board). The guidance device may be configured such that the trainer at least partially controls the board while the trainer is not physically on the board, such as on the upper surface (deck) of the board. In some embodiments, the guidance device is configured such that the trainer may interact with the guidance device from behind the board. The guidance device may facilitate control of the board by the trainer and supervision of the user by the trainer during use and operation of the board. In some embodiments, the guidance device includes one or more safety features to facilitate maintaining the board within a desired distance from the trainer while the board is in the water and used by the user.

Figure 1A:
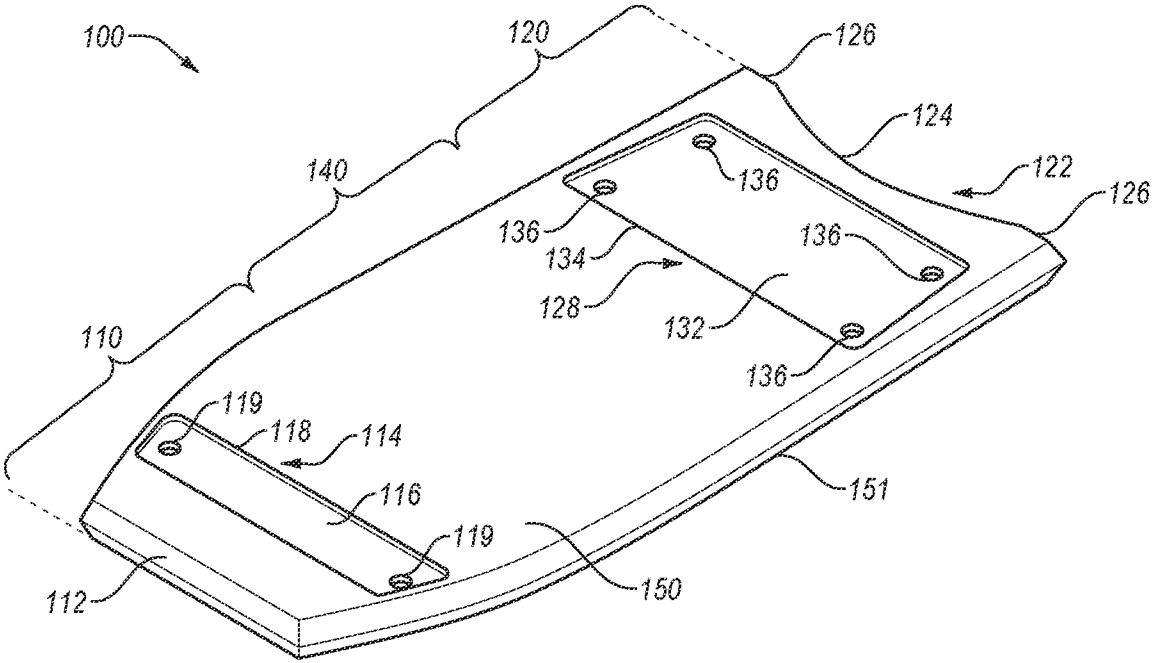
FIG. 1A is a simplified partial perspective view of a board, in accordance with embodiments of the disclosure.

FIG. 1A is a simplified partial perspective view of a board 100, in accordance with embodiments of the disclosure. The board 100 may be configured to float on water. By way of non-limiting example, the board 100 may comprise a bodyboard, a boogie board, a paddle board, a board for flowriding, a skimboard, a surfboard, or another type of board for water sports (e.g., surface water sports). In some embodiments, the board 100 comprises a bodyboard. In other embodiments, the board 100 comprises a boogie board. In some embodiments, the board 100 comprises a board configured to be operated by a user without the use of a motorized vehicle (e.g., without being towed behind, for example, a boat).

The board 100 may be configured to interchange between one or more configurations to facilitate, for example, training of a user for a particular water sport based on a level of experience of the user. For example, the board 100 may be configured to be removably coupled to one or more training devices to facilitate use by a user in the prone position, a user in the kneeling position, a user in the standing position, and a user in the sitting position. Further, the board 100 may include one or more portions configured to be removably coupled to a guidance device configured to facilitate at least partial control of the board 100 by a person other than the user (e.g., a trainer, a parent, a guardian, a supervisor, a coach, a caretaker).

The board 100 may comprise a front portion 110, a back portion 120, and a middle portion 140 (e.g., a center portion) between the front portion 110 and the back portion 120. The front portion 110 comprises a front surface 112. The front surface 112 may also be referred to herein as a "nose" or a "leading surface." In some embodiments, the front surface 112 is substantially linear. In other embodiments, the front surface 112 includes one or more curved (e.g., arcuate) portions. The back portion 120 comprises a back surface 122. The back surface 122 may also be referred to herein as a "tail" or a "trailing surface." The back surface 122 may include a curved (e.g., arcuate) surface 124. In some embodiments, the curved surface 124 is located laterally between substantially planar surface 126.

An upper surface 150 of the board 100 extends between the front surface 112 and the back surface 122. The upper surface 150 may also be referred to herein as the "deck" of the board 100 or a "top surface" of the board 100.

As will be described herein, in use and operation, a user may be positioned on the upper surface 150 of the board 100 facing the front surface 112. By way of non-limiting example, the user may be positioned on the upper surface 150 of the board 100 on the middle portion 140. The user may be in the prone position, kneeling, sitting, or standing. An individual other than the user (e.g., a trainer) may at least partially control the board while the individual is not physically on the board 100. By way of non-limiting example, the individual other than the user may at least partially control the board 100 from behind the board 100 (i.e., while facing the back surface 122).

The board 100 may comprise a material exhibiting a density less than a density of water (e.g., salt water) such that the board 100 floats on water. In some embodiments, the board 100 comprises a material exhibiting a buoyancy such that the board 100 floats on water with a user on the upper surface 150 of the board 100. By way of non-limiting example, the board 100 may be formed of and include foam material (e.g., a lightweight expanded foam) such as, for example, one or more of polyurethane foam, polyethylene, polystyrene (e.g., expanded polystyrene (EPS)), a mixture of polystyrene and polyethylene (e.g., ARCEL®; a mixture of about 70 percent polystyrene and about 30 percent polyethylene), polypropylene, a copolymer of ethylene and methacrylic acid (e.g., SURLYN® commercially available from DuPont), and high density polyethylene (HPDE). However, the disclosure is not so limited and the board 100 may be formed from one or more other materials. In some embodiments, the board 100 comprises a closed-cell foam material (e.g., closed cell polyurethane) such that the board 100 does not substantially absorb water. In some embodiments, one or more external surfaces of the board 100 comprises a coating, such as an epoxy coating, a resin laminate coating, or a polyester coating.

A bottom surface 151 of the board 100 (e.g., a surface of the board 100 opposing the upper surface 150) configured to contact the water during use and operation may comprise a different material composition than other portions of the board 100. In some embodiments, the bottom surface 151 comprises a material formulated and configured to exhibit a relatively low friction when in contact with water such that the board "glides" on the water. In some embodiments, the bottom surface 151 of the board 100 comprises one or more of polyethylene and a copolymer of ethylene and methacrylic acid.

With continued reference to FIG. 1A, the front portion 110 may include a first recessed portion 114 located proximate the front surface 112. The first recessed portion 114 may be defined by an upper recessed surface 116 (extending substantially parallel with the upper surface 150) and sidewalls 118 vertically extending between the upper recessed surface 116 and the upper surface 150. The upper recessed surface 116 may be recessed relative to the upper surface 150 of the board 100. Stated another way, the upper recessed surface 116 of the first recessed portion 114 may be located closer to the bottom surface 151 of the board 100 than the upper surface 150. In other words, the upper recessed surface 116 is located vertically between the upper surface 150 and the bottom surface 151 of the board 100.

One or more attachment means 119 (e.g., fastening means) may be located within the upper recessed surface 116 and extend at least partially into the board 100. In some embodiments, each of the attachment means 119 individually comprises an aperture extending at least partially into the board 100 and configured to receive one or more fastening means (e.g., a threaded fastener, such as a bolt, a stud, a screw) for removably attaching one or more training devices (e.g., one or more training attachments) to the board 100 and at least partially within the first recessed portion 114. In some embodiments, the attachment means 119 each individually comprises an internal threaded portion configured for receiving a threaded fastener. In some embodiments, the attachment means 119 do not extend completely through the board 100 and the bottom surface 151 is not penetrated by the attachment means 119. In some such embodiments, the functionality of the board 100 is not compromised (e.g., not substantially compromised) by the presence of the first recessed portion 114 and the friction between the bottom surface 151 and another surface is not increased by the presence of the first recessed portion 114 or the attachment means 119.

In some embodiments, the attachment means 119 are molded into the board 100. In other words, the attachment means 119 comprises apertures within the board and each comprising, for example, a female threaded portion. In some such embodiments, the threads may comprise substantially the same material composition as the board 100.

FIG. 1B is a simplified exploded view illustrating an attachment means 160 and a fastener 170 configured to couple with the attachment means 160 for attaching a removable attachment feature (e.g., a training device, a guidance device) to the board 100 (FIG. 1A), in accordance with embodiments of the disclosure. The attachment means 160 may include a sleeve 162 (e.g., a bushing) configured to be placed into the aperture of the board 100 (FIG. 1A). External surfaces of the sleeve 162 may be at least partially defined by ridges 164 configured to interact with surfaces of the board 100 defining the apertures. The sleeves 162 may be placed within the apertures within the board 100. The ridges 164 may be configured to increase an interaction between the attachment means 160 and the board 100. In some embodiments, the sleeves 162 are molded into the board 100. The sleeves 162 may each include threaded portions 166 (e.g., internal threaded portions; female threads) configured for interacting with a threaded portion 172 (e.g., external threaded portion; male threads) of a fastener 170. The fastener 170 may include, for example, a threaded fastener such as a bolt, a stud, a screw, or another type of fastener. Although FIG. 1A and FIG. 1B have been described and illustrated as including a particular attachment means 119, 160, the disclosure is not so limited. In other embodiments, the attachment means 119 may be different from that described.

As described in further detail below, the one or more training devices may be configured to be removably attached to the board 100, such as within the first recessed portion 114. The one or more training devices may be configured to facilitate different uses and modes of operation of the board 100, depending on level of experience of the user.

In use and operation, a portion of a training device (e.g., a mounting plate 204 (FIG. 2A)) may be placed within the first recessed portion 114 and apertures of the training device may be aligned with apertures of the attachment means 119 within the first recessed portion 114. The threaded portion 172 of the fastener 170 may be inserted through a respective aperture in the training device and secured to (e.g., threaded onto) the threaded portion 166 of the sleeve 162. A head 174 of the fastener 170 may be in contact with an upper surface of the training device to attach the training device to the board 100 within the first recessed portion 114. In other words, the portion of the training device may be vertically between the head 174 of the fasteners 170 and the upper recessed surface 116.

With reference again to FIG. 1A, the back portion 120 may include a second recessed portion 128 located proximate the back surface 122. The second recessed portion 128 may be defined by an additional upper recessed surface 132 (extending substantially coplanar with the upper recessed surface 116 and the upper surface 150) and sidewalls 134 vertically extending between the additional upper recessed surface 132 and the upper surface 150. Stated another way, the additional upper recessed surface 132 of the second recessed portion 128 may be located closer to the back surface of the board 100 than the upper surface 150.

One or more additional attachment means 136 (e.g., one or more additional fastening means) may be located within the additional upper recessed surface 132 and extend at least partially into the board 100. In some embodiments, the one or more additional attachment means 136 are substantially similar to the one or more attachment means 119 within the first recessed portion 114 and the attachment means 160 (FIG. 1B). For example, the one or more additional attachment means 136 may include apertures extending at least partially into the board 100 and configured to receive one or more fasteners 170 for removably attaching one or more guidance devices within the second recessed portion 128 of the board 100. In some embodiments, the one or more additional attachment means 136 comprise an internal threaded portion configured for receiving a fastener 170 (FIG. 1B).

In some embodiments, the additional attachment means 136 do not extend completely through the board 100 and the bottom surface 151 is not penetrated by the additional attachment means 136, as described above with reference to the attachment means 119. In some such embodiments, the functionality of the board 100 is not compromised (e.g., not substantially compromised) by the presence of the second recessed portion 128 and the friction between the bottom surface 151 and another surface is not increased by the presence of the second recessed portion 128 or the additional attachment means 136.

As described in further detail below, the one or more guidance devices may be configured to be removably attached to the board 100, such as within the second recessed portion 128. The one or more guidance devices may be configured to facilitate control of the board 100 by a supervisor from, for example, behind the back surface 122 of the board 100 while another (e.g., the user) is physically on the board 100, such as on the upper surface 150 of the board 100.

Figure 2A:
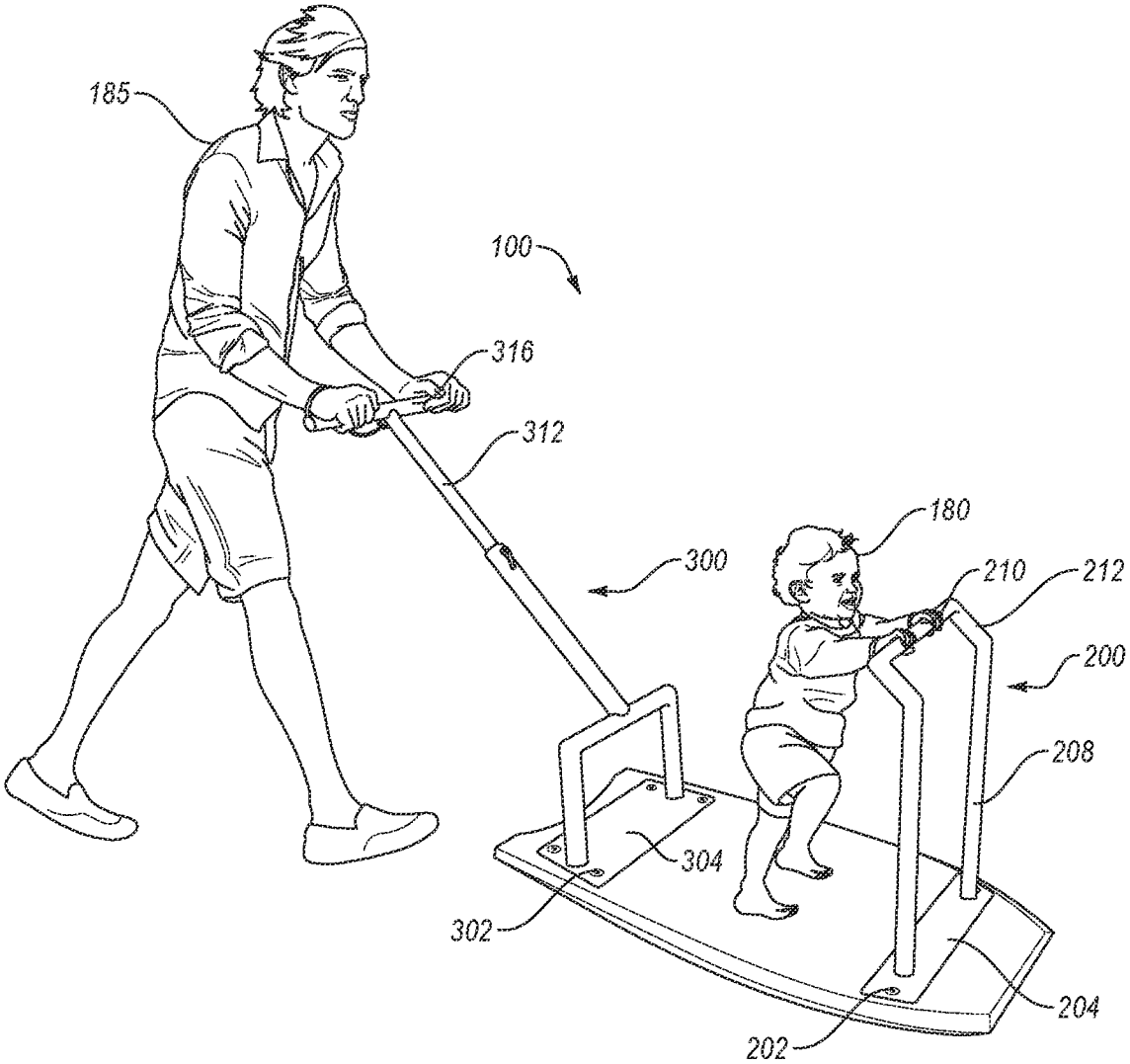
FIG. 2A is a simplified perspective view of the board of FIG. 1A in a particular configuration with a training device and a guidance device attached to the board, in accordance with embodiments of the disclosure.

FIG. 2A is a simplified perspective view of the board 100 in a particular configuration with a training device 200 and a guidance device 300 attached to the board 100, in accordance with embodiments of the disclosure. During use and operation, a user 180 may be positioned on a surface (e.g., the upper surface 150 (FIG. 1A)) of the board 100 and may retainably engage (e.g., hold onto, grab) the training device 200. A trainer 185 may at least partially control the board 100 by holding the guidance device 300 from the back of the board 100. The training device 200 is coupled to the board 100 within the first recessed portion 114 (FIG. 1A) by means of the one or more fasteners 202 coupled to the one or more attachment means 119 (FIG. 1A). The guidance device 300 is coupled to the board 100, such as within the second recessed portion 128 (FIG. 1A) by means of one or more fasteners 302 coupled to the one or more additional attachment means 136 (FIG. 1A).

Figure 2C:
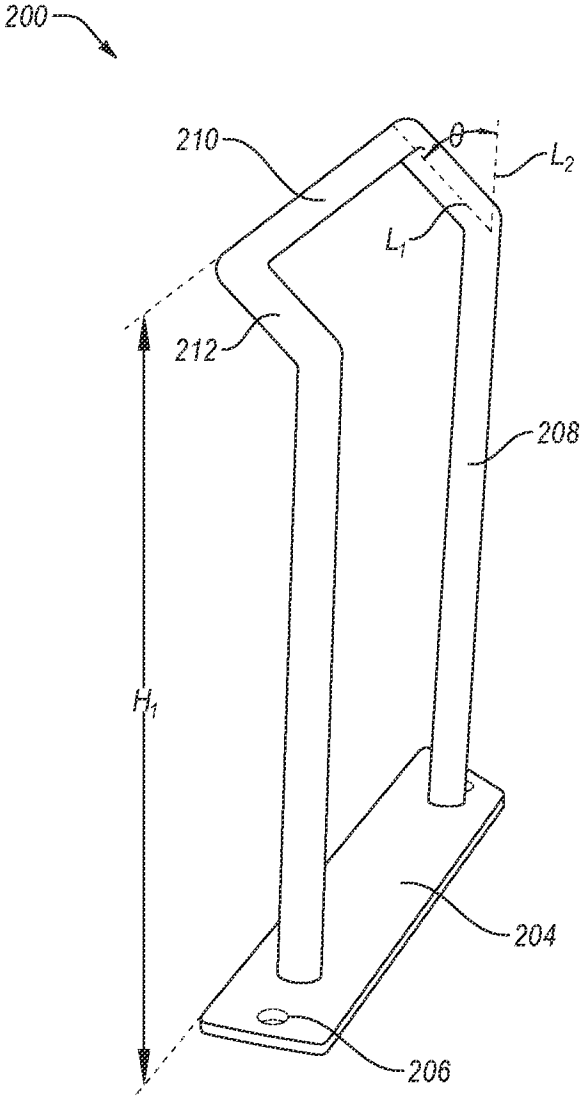
FIG. 2C is a simplified perspective view of the training device of FIG. 2B.
Figure 2B:
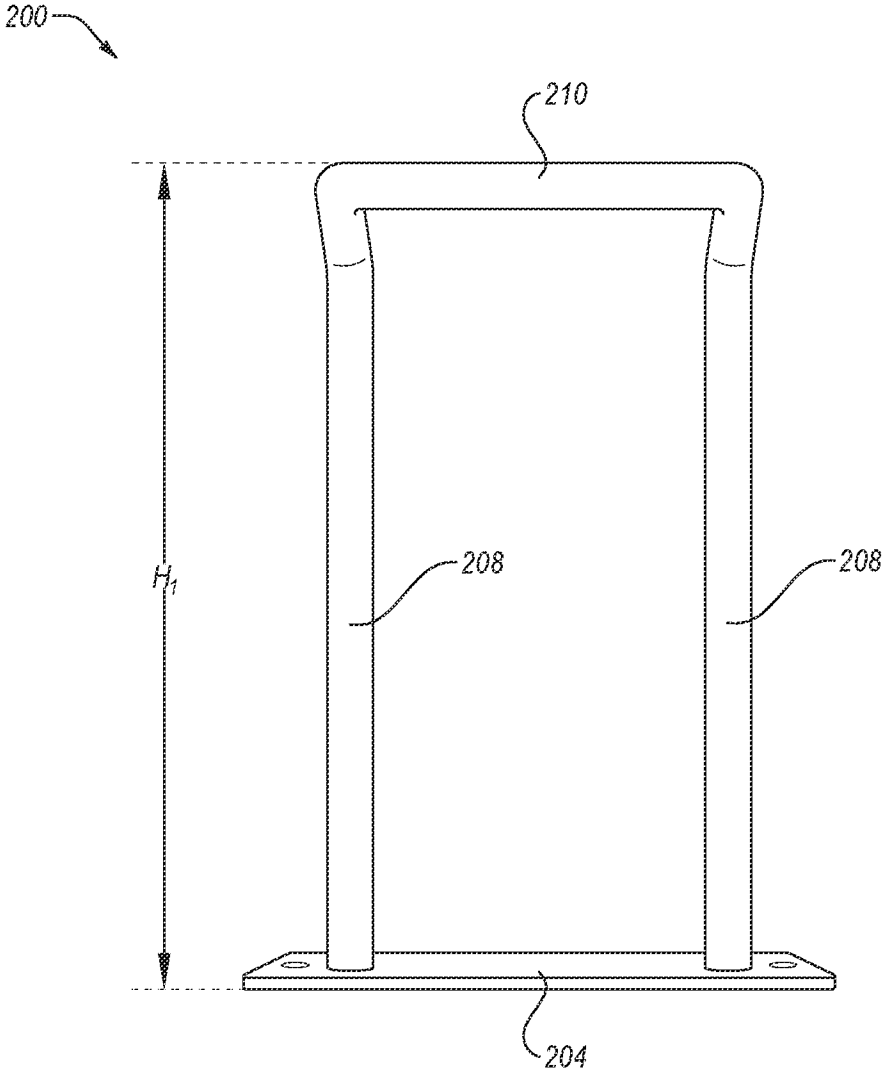
FIG. 2B is a simplified front view of a training device, in accordance with embodiments of the disclosure.

FIG. 2B is a simplified front view of the training device 200 and FIG. 2C is a simplified perspective view of the training device 200, in accordance with embodiments of the disclosure. With combined reference to FIG. 2A through FIG. 2C, the training device 200 includes a mounting plate 204 for removably attaching the training device 200 to the board 100.

The mounting plate 204 may include apertures 206 (FIG. 2C) configured to receive the fasteners 202 (FIG. 2A) at locations corresponding to the location of the one or more attachment means 119 (FIG. 1A). In use and operation, the mounting plate 204 may be secured to the board 100 by aligning the apertures 206 of the mounting plate 204 with the corresponding attachment means 119 of the board 100, extending the fasteners 202 through the apertures 206, and attaching the fasteners 202 to the board 100.

The mounting plate 204 may be sized and shaped to fit within the first recessed portion 114 (FIG. 1A). In some embodiments, the upper surface of the mounting plate 204 may be configured to be substantially coplanar with the upper surface 150 (FIG. 1A) when the training device 200 is attached to the board 100 within the first recessed portion 114.

Vertically extending posts (e.g., bars) 208 may be attached to the mounting plate 204 and extend substantially perpendicular from the mounting plate 204. The vertically extending posts 208 may extend substantially perpendicular to the major surface of the mounting plate 204 and the upper surface 150 of the board 100. In some embodiments, the training device 200 includes two vertically extending posts 208. In some embodiments, the vertically extending posts 208 are substantially permanently attached (e.g., affixed, secured) to the mounting plate 204.

A handle 210 may laterally extend between the vertically extending posts 208. In some embodiments, angled portions 212 may extend between the vertically extending posts 208 and the handle 210 to facilitate alignment of the handle 210 for a user during use and operation of the training device 200 with the board 100. In some embodiments, a longitudinal axis $L_1$ of the angled portions 212 may be oriented at an angle θ with respect to a longitudinal axis $L_2$ of the vertically extending posts 208.

The angle θ may be within a range from about 10° to about 90°, such as from about 10° to about 30°, from about 30° to about 45°, from about 45° to about 60°, from about 60° to about 80°, or from about 80° to about 90°. However, the disclosure is not so limited and the angle θ may be different from those described. In some embodiments, the training device 200 does not include the angled portions 212 (e.g., the angle θ is about 0°). In some embodiments, the angle is θ about 90°

With continued reference to FIG. 2B and FIG. 2C, a height $H_1$ of the training device 200 (e.g., a distance between the major surface of the mounting plate 204 and an upper surface of the handle 210) may be selected based on a height of an intended user. The height $H_1$ may be within a range from about 45.72 centimeters (cm) (about 18 inches) to about 121.92 cm (about 48 inches), such as from about 45.72 cm (about 18 inches) to about 60.96 cm (about 24 inches), from about 60.96 cm (about 24 inches) to about 76.2 cm (about 30 inches), from about 76.2 cm (about 30 inches) to about 91.44 cm (about 36 inches), from about 91.44 cm (about 36 inches) to about 106.68 cm (about 42 inches), or from about 106.68 cm (about 42 inches) to about 121.92 cm (about 48 inches).

As will be described in further detail below, in some embodiments, the training device 200 includes a telescoping means configured to facilitate altering the height $H_1$ of the handle 210. In some embodiments, the vertically extending posts 208 are configured to telescope such that the height $H_1$ of the training device 200 may be altered based on an intended use of the board 100 (e.g., a height of the user).

Figure 2E:
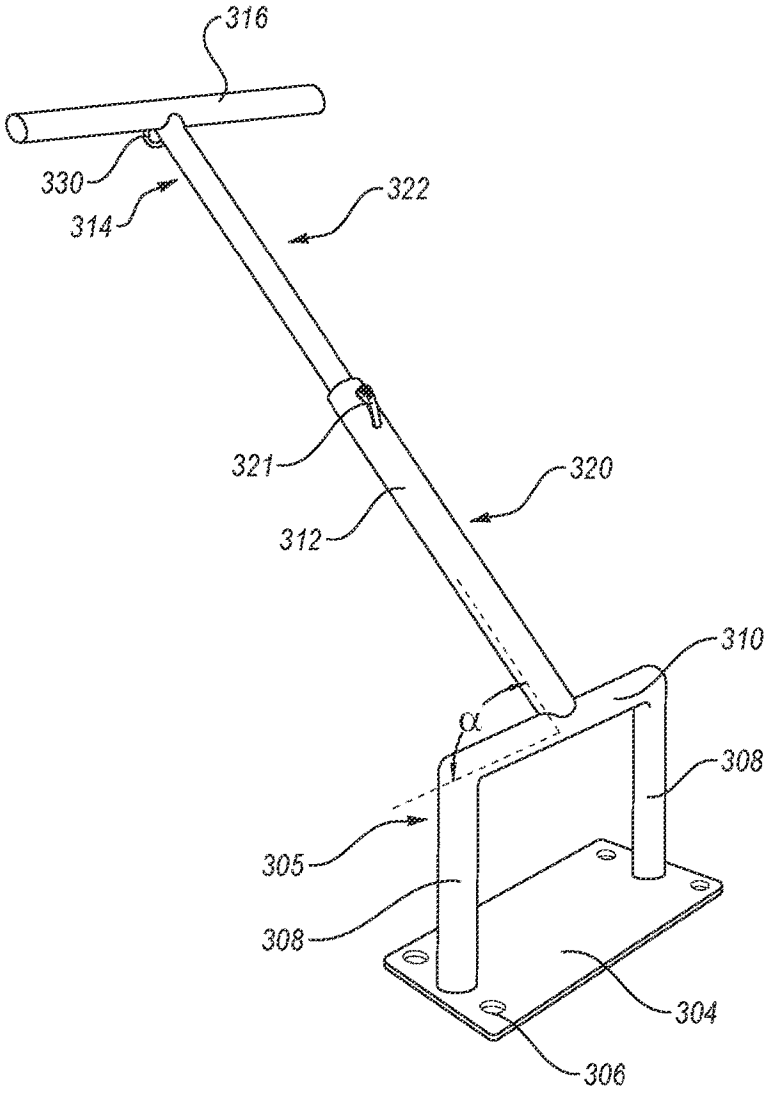
FIG. 2D and FIG. 2E are simplified perspective views of a guidance device, in accordance with embodiments of the disclosure.
Figure 2D:
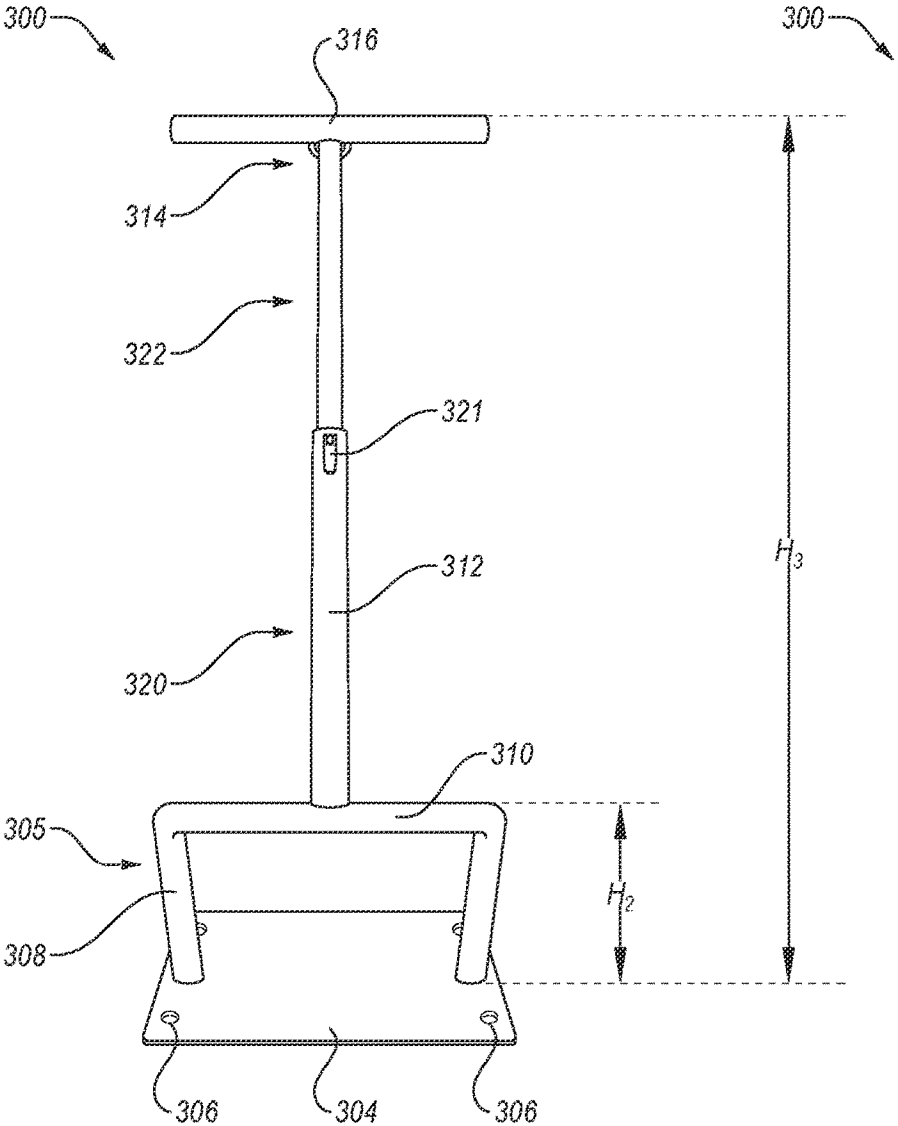

FIG. 2D and FIG. 2E are simplified perspective views of the guidance device 300, in accordance with embodiments of the disclosure. With combined reference to FIG. 2A, FIG. 2D, and FIG. 2E, the guidance device 300 may include a mounting plate 304 for removably attaching the guidance device 300 to the board 100.

The mounting plate 304 may be substantially similar to the mounting plate 204 of the training device 200. The mounting plate 304 may include apertures 306 (FIG. 2D, FIG. 2E) configured to receive the fasteners 302 (FIG. 2A) at locations corresponding to the location of the one or more additional attachment means 136 (FIG. 1A). In use and operation, the mounting plate 304 may be secured to the board 100 by aligning the apertures 306 of the mounting plate 304 with the corresponding additional attachment means 136 of the board 100, extending the fasteners 302 through the apertures 306, and attaching the fasteners 302 to the board 100.

The mounting plate 304 may be attached to a vertical standoff 305 that may be, in turn, attached to an angled post 312. The vertical standoff 305 may comprise vertically extending posts 308 attached to the mounting plate 304, as described above with reference to the vertically extending posts 208 (FIG. 2B, FIG. 2C) and the mounting plate 204 (FIG. 2B, FIG. 2C) of the training device 200 (FIG. 2B, FIG. 2C). The vertically extending posts 308 may extend substantially perpendicular to the major surface of the mounting plate 304 and the upper surface 150 (FIG. 1A) of the board 100. In some embodiments, the vertical standoff 305 includes two vertically extending posts 308. In some embodiments, the vertically extending posts 308 are substantially permanently attached (e.g., affixed, secured) to the mounting plate 304.

The vertical standoff 305 may have a height $H_2$ within a range from about 15.24 cm (about 6 inches) to about 60.96 cm (about 24 inches), such as from about 15.24 cm (about 6 inches) to about 30.48 cm (about 12 inches), from about 30.48 cm (about 12 inches) to about 45.72 cm (about 18 inches), or from about 45.72 cm (about 18 inches) to about 60.96 cm (about 24 inches). In some embodiments, the height $H_2$ is between about 15.24 cm (about 6 inches) to about 30.48 cm (about 12 inches).

The vertical standoff 305 may include a laterally extending bar 310 coupled to and laterally extending between the vertically extending posts 308. A longitudinal axis of the laterally extending bar 310 may be substantially parallel with the major surface of the mounting plate 304. The laterally extending bar 310 may be attached to and connect the vertically extending posts 308.

The angled post 312 may be coupled to the vertical standoff 305, such as to the laterally extending bar 310. In some embodiments, the angled post 312 is connected to a laterally central portion of the laterally extending bar 310. In other words, the angled post 312 may be connected to the laterally extending bar 310 laterally between the vertically extending posts 308.

An angle $\alpha$ between the longitudinal axis of the laterally extending bar 310 and the longitudinal axis of the angled post 312 (e.g., corresponding to the angle between the plane of the upper surface 150 and the longitudinal axis of the angled post 312) may be within a range from about 10° to about 60°, such as from about 10° to about 20°, from about 20° to about 40°, or from about 40° to about 60°. In some embodiments, the angle $\alpha$ is about 30°. In other embodiments, the angle $\alpha$ is about 45°. In yet other embodiments, the angle $\alpha$ is about 60°.

A distal end 314 of the angled post 312 may be attached to a laterally extending handle 316. The laterally extending handle 316 may be sized and shaped to facilitate control of the board 100 (FIG. 1A) by a trainer. In some embodiments, the trainer control the board 100 (FIG. 1A) from behind the board 100 by means of a guidance device 300 while a user 180 is physically on the board 100, such as on the upper surface 150 (FIG. 1A) of the board 100 and using the training device 200 (FIG. 2A). In some embodiments, the handle 316 is located outside the lateral boundaries of the back portion 120 (FIG. 1A) of the board 100.

In some embodiments, a retaining device 330 is attached to the guidance device 300, such as to the handle 316. The retaining device 330 may define an aperture therethrough and may be configured to receive, for example, a cord (e.g., a rope). In some embodiments, the retaining device 330 comprises a carabiner. In use and operation, the trainer 185 using the guidance device 300 may secure the cord to themselves and through the aperture of the retaining device 330 to reduce a likelihood of the board 100 (FIG. 2A) traveling more than a predetermined distance from the trainer 185.

In some embodiments, the guidance device 300 may be configured to be adjusted based on the height of the trainer (i.e., how tall the trainer is) using the guidance device 300. The guidance device 300 may include a telescoping means 321 such that a height $H_3$ of the guidance device 300 may be selectively adjusted based on a height of the individual using the guidance device 300. By way of non-limiting example, in some embodiments, the angled post 312 may comprise a first tube 320 coupled to the laterally extending bar 310 and a second tube 322 coupled to the first tube 320 and to the handle 316.

In some embodiments, the second tube 322 has a smaller outer diameter than an inner diameter of the first tube 320 such that the second tube 322 may telescope into and out of the first tube 320 to modify the length of the angled post 312, depending on a height of the trainer. In some embodiments, the telescoping means 321 may be configured to clamp a position of the second tube 322 with respect to the first tube 320 to secure the length of the angled post 312. In some embodiments, the telescoping means 321 comprises a clamping means, such as a telescoping tube clamp, a flip lock clamp, a twist lock clamp, or another telescoping means.

In other embodiments, the telescoping means 321 includes one or more other methods of telescoping. In some embodiments, one of the first tube 320 and the second tube 322 may include a plurality of spaced apertures and the other of the first tube 320 and the second tube 322 includes a pin (e.g., a detent) configured to interact with a desired one of the apertures. For example, as the second tube 322 is moved relative to the first tube 320, the apertures may be moved relative to the pin. Once the height of the angled post 312 is at a desired position, the pin may be coupled to the nearest aperture to secure the position of the second tube 322 with respect to the first tube 320 and the corresponding height of the angled post 312.

Although the guidance device 300 has been described and illustrated as including the vertical standoff 305 and the vertically extending posts 308, the disclosure is not so limited. In other embodiments, the angled post 312 may be directly coupled to the mounting plate 304 and the guidance device 300 may not include the vertical standoff 305 and the vertically extending posts 308.

Figure 3B:
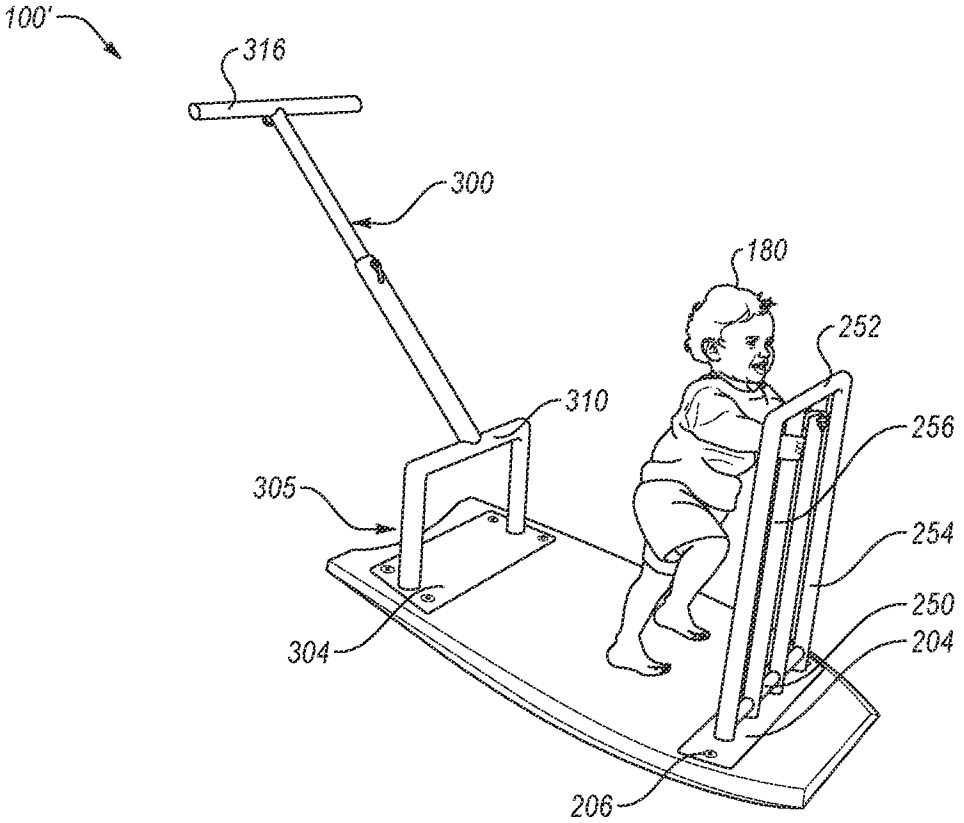
FIG. 3B is a simplified perspective view of a board including the training device and the guidance device attached to the board, in accordance with embodiments of the disclosure.
Figure 3A:
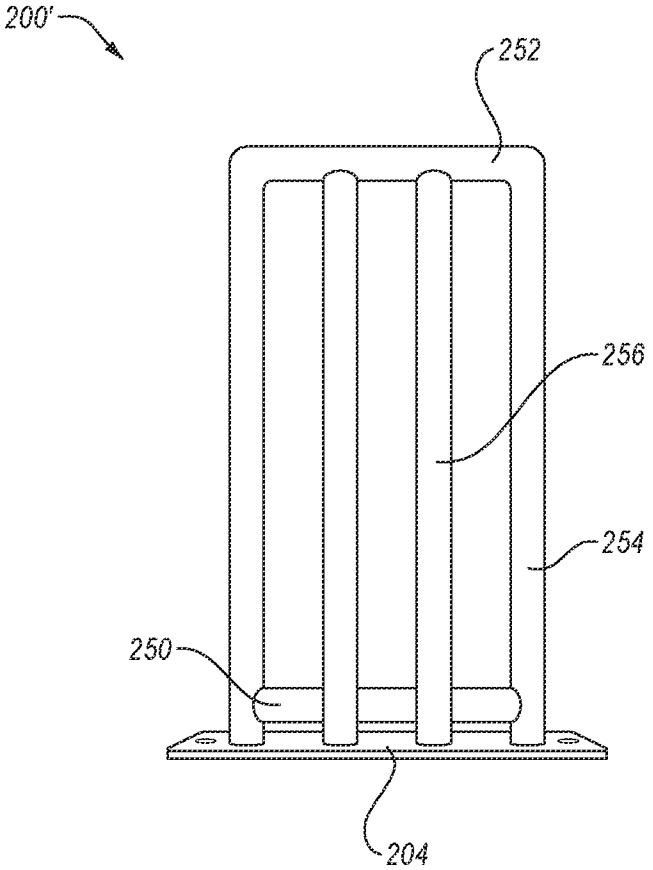
FIG. 3A is a simplified front view of a training device, in accordance with additional embodiments of the disclosure.

Although the training device 200 of FIG. 2A through FIG. 2C has been described and illustrated as comprising a particular configuration, the disclosure is not so limited. FIG. 3A is a simplified front view of a training device 200', in accordance with additional embodiments of the disclosure. FIG. 3B is a simplified perspective view of a board 100' including the training device 200'. The training device 200' may be substantially similar to the training device 200 described above with reference to FIG. 2A through FIG. 2C, except that the training device 200' includes more than two vertically extending posts 208, a lower handle 250, and an upper handle 252.

The upper handle 252 may be substantially similar to the handle 210 (FIG. 2A through FIG. 2C). The lower handle 250 may be configured to facilitate use of the board 100' by a user in the prone position (i.e., the user laying on board 100 with the user's stomach on the upper surface 150 (FIG. 1A) of the board 100').

The training device 200' may include outer vertically extending posts 254 and inner vertically extending posts 256 located between the outer vertically extending posts 254. The outer vertically extending posts 254 may be substantially similar to the vertically extending posts 208 (FIG. 2A through FIG. 2C) described above with reference to the training device 200 (FIG. 2A through FIG. 2C). The outer vertically extending posts 254 may be attached to the mounting plate 204.

The lower handle 250 may extend laterally between and connect the outer vertically extending posts 254. In some embodiments, the lower handle 250 is located proximate the mounting plate 204 such that in use and operation, the lower handle 250 is proximate the upper surface 150 (FIG. 1A) of the board 100'.

The inner vertically extending posts 256 may be attached to the lower handle 250. The inner vertically extending posts 256 may be configured to provide one or more handles for a user during use and operation of the board 100'. For example, a user may be in the kneeling position and may grab one or more of the inner vertically extending posts 256 and the outer vertically extending posts 254.

With continued reference to FIG. 3A, each of the outer vertically extending posts 254 and each of the inner vertically extending posts 256 individually vertically extends from the lower handle 250 to the upper handle 252.

In some embodiments, the training device 200' is configured to facilitate operation of the board 100' by a user in multiple desired positions. For example, the user may use the board 100' with the training device 200' while in the prone position, in the kneeling position, or in the standing position.

In FIG. 3B, the user 180 is standing on the board 100' and grabbing the inner vertically extending posts 256.

Figure 4:
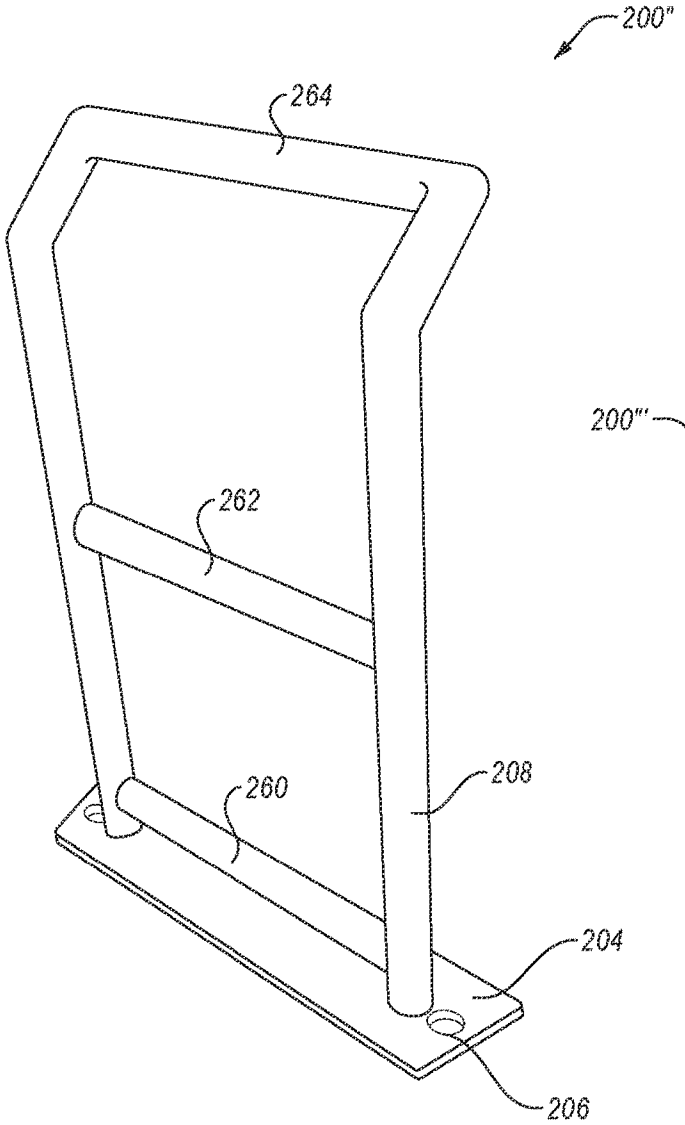
FIG. 4 is a simplified perspective view of a training device, in accordance with further embodiments of the disclosure.

FIG. 4 is a simplified perspective view of a training device 200", in accordance with further embodiments of the disclosure. The training device 200" may be substantially similar to the training device 200 described above with reference to FIG. 2A through FIG. 2C, except that the training device 200" includes a lower handle 260, a middle handle 262, and an upper handle 264.

With reference to FIG. 4, the training device 200" includes the lower handle 260 laterally extending between the vertically extending posts 208, the middle handle 262 vertically above the lower handle 260 and laterally extending between the vertically extending posts 208, and the upper handle 264 vertically above the middle handle 262 and laterally extending between the vertically extending posts 208.

In use and operation, the lower handle 260 may be configured to facilitate use of the board 100 (FIG. 1A) by a user in the prone position; the middle handle 262 may be configured to facilitate use of the board 100 by a user in the kneeling position; and the upper handle 264 may be configured to facilitate use of the board 100 by a user in the standing position.

Figure 5:
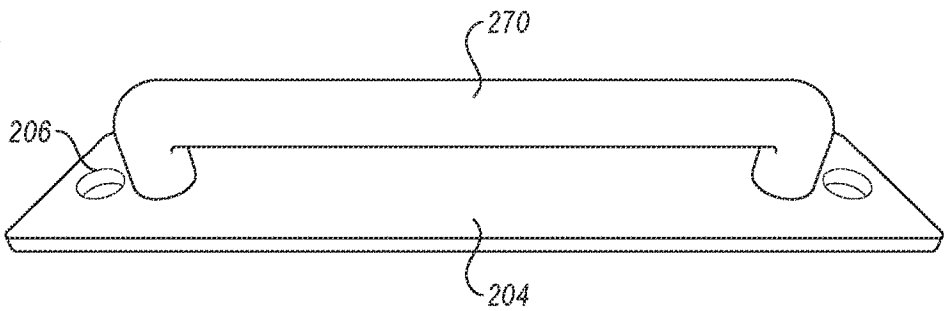
FIG. 5 is a simplified perspective view of a training device, in accordance with additional embodiments of the disclosure.

FIG. 5 is a simplified perspective view of a training device 200''', in accordance with additional embodiments of the disclosure. The training device 200''' may be configured to be removably attached to the board 100 (FIG. 1A), as described above with reference to the training devices 200, 200', and 200". The training device 200''' includes a handle 270 vertically spaced from the mounting plate 204 and configured to facilitate use of the board 100 by a user in the prone position. In some embodiments, the handle 270 may be spaced from the mounting plate 204 a distance within a range from about 2.54 cm (about 1 inch) to about 15.24 cm (about 6 inches), such as from about 2.54 cm (about 1 inch) to about 5.08 cm (about 2 inches), from about 5.08 cm (about 2 inches) to about 10.16 cm (about 4 inches), or from about 10.16 cm (about 4 inches) to about 15.24 cm (about 6 inches).

Figure 6:
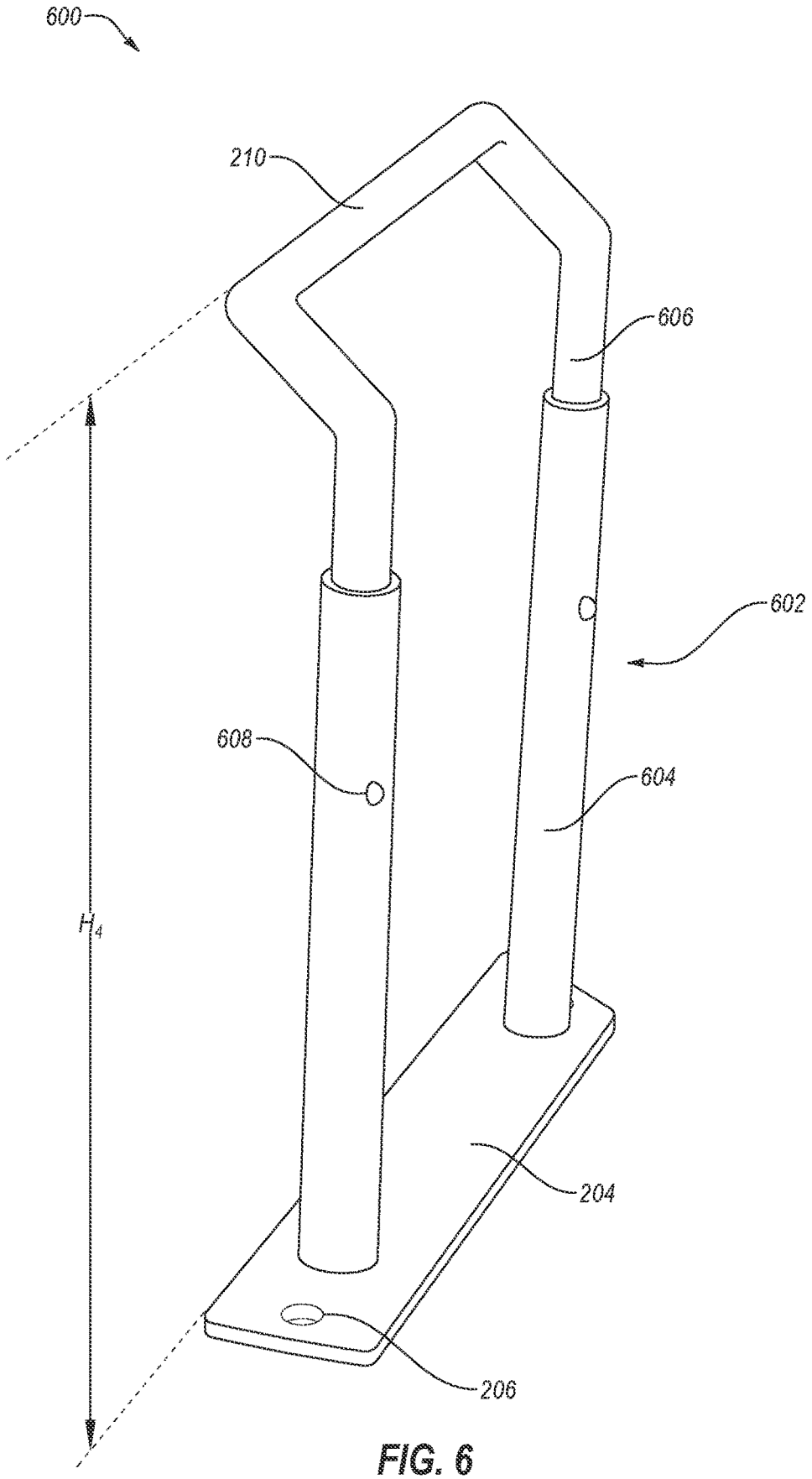
FIG. 6 is a simplified perspective view of a training device, in accordance with yet additional embodiments of the disclosure.

Although the training devices 200, 200', 200", and 200''' have been described as comprising substantially fixed dimensions, the disclosure is not so limited. FIG. 6 is a simplified perspective view of a training device 600, in accordance with yet additional embodiments of the disclosure. The training device 600 may be substantially similar to the training device 200 described above with reference to FIG. 2A through FIG. 2C. However, the training device 600 may include a means for changing an overall length of the training device and a corresponding height $H_4$ of the handle 210 relative to the mounting plate 204.

In some embodiments, the training device 600 includes vertically extending posts 602 configured to telescope to adjust the height $H_4$ of the training device 600. For example, the vertically extending posts 602 may each individually include a first tube 604 and a second tube 606 configured to interact with the first tube 604. The outer diameter of the second tube 606 may be less than the inner diameter of the first tube 604 such that the second tube 606 may retract into and extend out of the first tube 604 in a telescoping manner.

With continued reference to FIG. 6, one of the first tube 604 and the second tube may include a plurality of spaced apertures and the other of the first tube 604 and the second tube 606 may include a pin 608 (e.g., a detent) configured to interact with a desired one of the apertures, as described above with reference to the angled post 312 (FIG. 2D, FIG. 2E). For example, as the second tube 606 is moved relative to the first tube 604, the apertures may be moved relative to the pin 608. Once the height of the vertically extending posts 602 are at a desired position, the pin 608 may be coupled to the nearest aperture to secure the position of the second tube 606 with respect to the first tube 604 and the corresponding height of the vertically extending posts 602.

Although FIG. 6 has been described and illustrated as including a particular telescoping means, the disclosure is not so limited and the height $H_4$ of the training device 600 may be adjusted using other telescoping means, as known in the art. By way of non-limiting example, the first tube 604 and the second tube 606 may not include apertures or the pin 608. Rather, the first tube 604 and the second tube 606 may be attached by a clamp configured to fix the location of the second tube 606 with respect to the first tube 604. In some embodiments, the second tube 606 may be moved into and/or out of the first tube 604 a desired amount to modify the height $H_4$ and the clamping device may be configured to secure the location of the second tube 606 with respect to the first tube 604 at the desired position (and the corresponding height $H_4$).

Although the board 100, 100' (FIG. 1A, FIG. 3B) has been described and illustrated as comprising a training device (e.g., training devices 200, 200', 200", and 200'") and the guidance device (e.g., the guidance device 300) attached to the board 100, 100', the disclosure is not so limited. In some embodiments, the rather than attaching the training device 200, 200', 200", and 200'" and the guidance device 300 to the board 100, 100', a first plate corresponding to the size and shape of the first recessed portion 114 (FIG. 1A) may be attached to the 100, 100' and a second plate corresponding to the size and shape of the second recessed portion 128 (FIG. 1A) may be attached to the board 100, 100'. The first plate may be substantially the same as the mounting plate 204 (FIG. 2A through FIG. 2C) and the second plate may be substantially similar to the mounting plate 304 (FIG. 2D, FIG. 2E).

Figure 7:
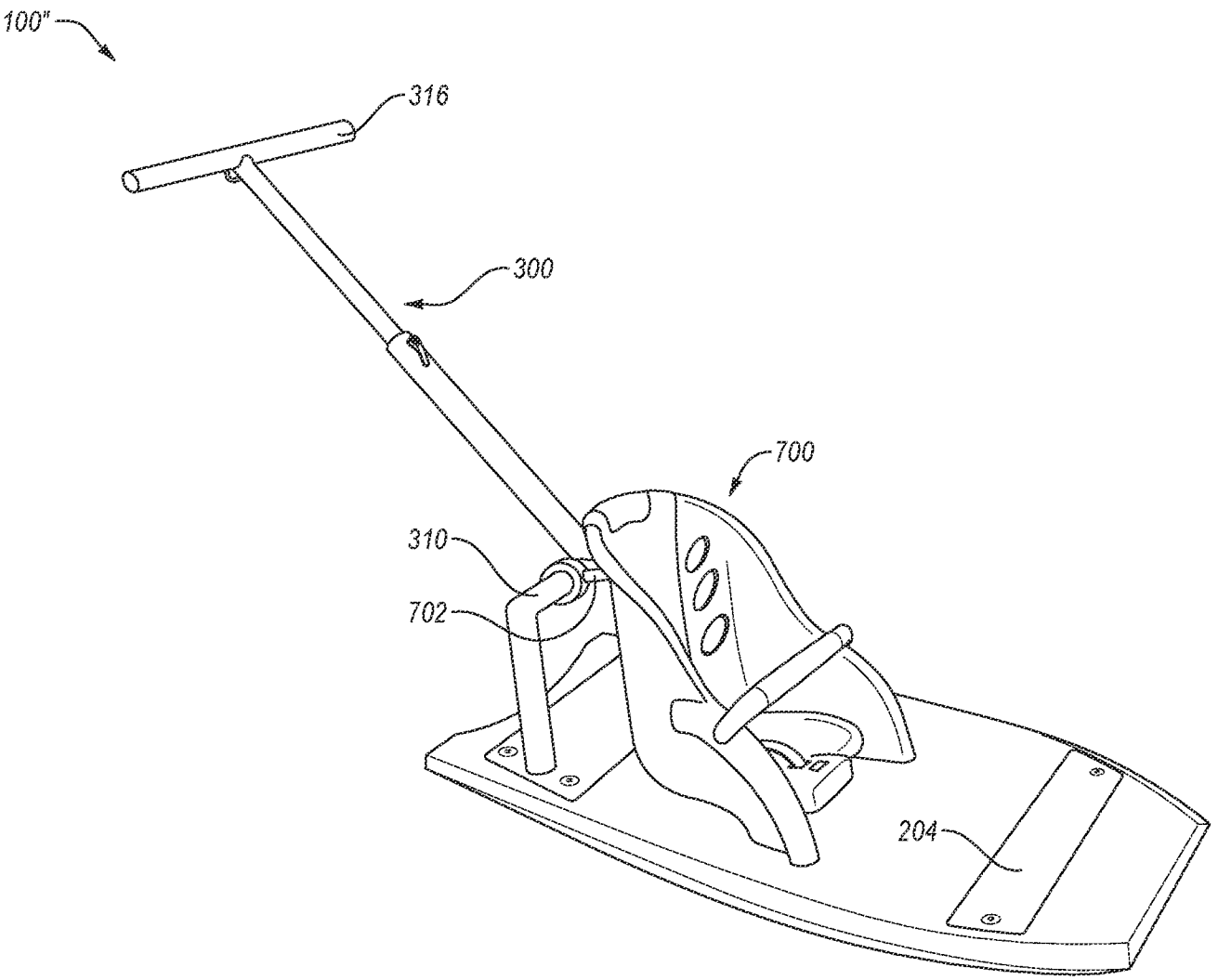
FIG. 7 is a simplified perspective view of a board including a chair attached to a guidance device, in accordance with embodiments of the disclosure.

Although the board 100 has been described and illustrated as facilitating use of the board 100 by a user in one of the prone, kneeling, and standing position, the disclosure is not so limited. In other embodiments, the board 100 may be configured to facilitate operation thereof by a user in the sitting position. FIG. 7 is a simplified perspective view of a board 100" including a chair 700 attached to the guidance device 300 of the board 100", in accordance with embodiments of the disclosure.

In some embodiments, the chair 700 is configured to be removably coupled to the guidance device 300. For example, the chair 700 may include one or more attaching means 702 coupled to the back of the chair 700 and configured to couple to the guidance device 300, such as to the laterally extending bar 310. In other embodiments, the chair 700 may include one or more apertures configured to couple the chair 700 to the board 100" with, for example, one or more fasteners. In some embodiments, the board 100" may be configured to facilitate use of the board 100" by a user in the sitting position.

Accordingly, a board may be configured to be removably coupled to one or more training devices to facilitate use of the board by a user in one or more different positions (e.g., based on a size and/or experience of the user). The board may be configured to be removably coupled to a guidance device such that a trainer (e.g., guardian) may at least partially control the board while the board is used by the user. The board may be used by, for example, parents interested in training others (e.g., children) how to, for example, bodyboard.

While embodiments of the disclosure may be susceptible to various modifications and alternative forms, specific embodiments have been shown by way of example in the drawings and have been described in detail herein. However, it should be understood that the disclosure is not limited to the particular forms disclosed. Rather, the disclosure encompasses all modifications, variations, combinations, and alternatives falling within the scope of the disclosure as defined by the following appended claims and their legal equivalents.

What is claimed is:

1. A board for water sports, the board comprising:
a front surface;
a back surface;
an upper surface between the front surface and the back surface; and
an attachment means for removably and rigidly attaching each of:
a training device proximate the front surface of the board and configured for use by a user on the upper surface of the board; and
a guidance device proximate the back surface of the board, the guidance device configured to facilitate at least partial control of the board by a trainer behind the board while the board is on water.

2. The board of claim 1, wherein the training device comprises:
vertically extending posts; and
a handle laterally extending between the vertically extending posts.

3. The board of claim 2, wherein the handle is coupled to the vertically extending posts by angled portions extending at an angle relative to a longitudinal axis of the vertically extending posts.

4. The board of claim 1, wherein the training device comprises:
a mounting plate; and
a handle coupled to the mounting plate and configured to facilitate use of the board by a user in a prone position.

5. The board of claim 1, wherein the guidance device comprises a handle configured to be used by an individual from behind the board.

6. The board of claim 1, further comprising a retaining means coupled to a handle of the guidance device.

7. The board of claim 6, wherein the retaining means comprises a carabiner.

8. The board of claim 1, wherein the training device comprises a chair.

9. The board of claim 1, wherein the training device comprises an upper handle and a lower handle.

10. A set for a board for water board sports, the set comprising:
a board for a water board sport, the board having a density configured to facilitate floating of the board on water;
a first training device comprising a first handle removably coupled to a front portion of the board and configured for use by a user of the board; and
a guidance device comprising a second handle removably coupled to a rear portion of the board, wherein the second handle is static relative to the board and configured for use by a trainer behind the board while the board is on water.

11. The set of claim 10, further comprising a second training device comprising:
an upper handle;
a lower handle; and
at least one vertical handle, wherein the second training device is configured to removably couple to the board.

12. The set of claim 10, further comprising a chair configured to removably attach to the guidance device.

13. The set of claim 10, further comprising a retaining means coupled to the second handle.

14. The set of claim 10, wherein the first training device further comprises:

a second handle vertically below the first handle; and a third handle vertically below the second handle.

15. A board for board sports, the board comprising:

a training device configured to removably attach to the board, the training device comprising:

vertically extending posts coupled to a front portion of the board; and a first handle coupled to the vertically extending posts; and a guidance device configured to removably and rigidly attach to the board, the guidance device comprising:

an angled post coupled to a back portion of the board; and a second handle coupled to the angled post.

16. The board of claim 15, wherein the guidance device comprises a retaining means.

17. The board of claim 15, wherein the guidance device comprises a telescoping means configured to change a length of the angled post.

18. The board of claim 15, wherein the angled post comprises a first portion having a larger inner diameter than an outer diameter of a second portion of the angled post.

19. The board of claim 15, wherein the training device further comprises an additional handle vertically below the first handle.

20. The board of claim 15, wherein the guidance device comprises an attachment means for removably coupling a chair to the guidance device.

21. A board for board sports, the board comprising:

a front surface;

a back surface;

an upper surface between the front surface and the back surface; and an attachment means for removably and rigidly attaching a training device proximate the front surface of the board and a guidance device proximate the back surface of the board, the guidance device configured to facilitate at least partial control of the board, the training device comprising:

vertically extending posts; and a handle laterally extending between the vertically extending posts.

22. A board for water board sports, the board comprising:

a front surface;

a back surface;

an upper surface between the front surface and the back surface; and an attachment means for removably and rigidly attaching a training device comprising a chair proximate the front surface of the board and a guidance device proximate the back surface of the board, the guidance device configured to facilitate at least partial control of the board while the board is on water.

* * * * *